US005725131A

United States Patent [19]

Bell et al.

[11] Patent Number: 5,725,131

[45] Date of Patent: Mar. 10, 1998

[54] POWDER DISPENSING DISPENSER VALVE AND DISPENSING ASSEMBLY

[75] Inventors: Ronald F. Bell, Uniontown; Michael J. Dolan, Akron; John M. Tosill, Barberton; J. Christopher Wysocki, Stow, all of Ohio

[73] Assignee: GOJO Industries, Inc., Cuyahoga Falls, Ohio

[21] Appl. No.: 652,987

[22] Filed: May 24, 1996

[51] Int. Cl.[6] ..... B65D 37/00

[52] U.S. Cl. ..... 222/196; 222/213; 222/246; 222/181.3; 222/507

[58] Field of Search ..... 222/181.3, 196, 222/243, 246, 207, 212, 214, 213, 321.7, 564, 513, 514, 505–509, 522, 525

[56] References Cited

U.S. PATENT DOCUMENTS

| | | | |
|---|---|---|---|
| 2,696,337 | 12/1954 | Dinhofer | 222/213 X |
| 2,857,080 | 10/1958 | Elias | 222/213 |
| 3,072,299 | 1/1963 | Sessions et al. | 222/246 |
| 3,244,332 | 4/1966 | Rogers | 222/213 |
| 4,011,969 | 3/1977 | Martin | 222/196 |
| 4,356,848 | 11/1982 | Spies | 222/514 X |
| 4,621,749 | 11/1986 | Kanfer | 222/214 X |
| 5,265,772 | 11/1993 | Bartasevich et al. | 222/214 |
| 5,370,267 | 12/1994 | Schroeder | 222/1 |

*Primary Examiner*—Kevin P. Shaver
*Attorney, Agent, or Firm*—Reese Taylor

[57] ABSTRACT

A valve and dispensing assembly for dispensing powdered material from a container includes a flexible tube intended to be collapsed to actuate a valve which permits the tube to selectively open for dispensing the material through the tube. The assembly includes a flexible tube apparatus including a body attachable to the container and a valve releasably received within the tube and normally closing it off. Collapse of the tube causes it to move relatively of the valve to unseat it and open the tube for material discharge. The assembly also includes a declumper secured to the tube for movement therewith during collapse of the tube. The valve closes off the tube when in its uncollapsed condition while the tube and declumper move relatively of the valve during collapse to open the tube. A portion of the declumper is bifurcated and has serrated opposed edges which can engage the head of the valve during the tube collapse to assist in breaking up clumps which may have formed in the material.

23 Claims, 6 Drawing Sheets

POWDER DISPENSING DISPENSER VALVE AND DISPENSING ASSEMBLY

RELATED PATENT APPLICATIONS

None.

FIELD OF THE INVENTION

This invention relates in general to the material dispensing art and relates in particular to dispensers of dry powdered material from wall mounted dispensers of the type adapted to receive replaceable containers of the material.

BACKGROUND OF THE INVENTION

It is known in the art of dispensing materials, such as soap or other cleaning products, as well as many other products, that wall-mounted dispensers which receive replaceable containers are an effective way of providing and dispensing the material. The dispensers, particularly those containing soap or other cleaning materials, are normally mounted adjacent sinks or other convenient places either in restrooms or in or adjacent to the work place, and generically comprise a mounting means or body which can be affixed to a supporting surface and a cover which can be swung open, upon disengagement of latching means, to open the dispenser for receipt of a bag or other replaceable container containing the material.

Generally, the containers include a valving and dispensing spout, tube or nozzle which discharges material below the bottom of the dispenser and seats in the dispenser for engagement and locating purposes and is actuated by a hand-engaging lever, which is either lifted or pushed up or toward or pulled away from a mounting surface to activate the valving and dispensing means and thereby dispense the product onto the hand of the user.

The prior art contains numerous examples of dispensers of this type. Some examples can be seen in Kanfer U.S. Pat. No. 4,621,749; Bartasevich U.S. Pat. No. 5,265,772 and Schroeder U.S. Pat. No. 5,370,267.

The patent prior art just mentioned generally includes the elements referred to above and all of the particular patents just referred to also involve the dispensing of liquid material. However, many of the soaps or other cleaning agents in common use also are provided in powder form and are also dispensed from dispensers which are similarly mounted. Such dispensers are generally constructed and operate much as the liquid dispensers in that they are hand actuated.

Such dispensers are also refillable. However, generally the valving mechanism in powder dispensers is part of the dispenser mechanism rather than part of the refill cartridge or container as is the case with many of the liquid systems. Thus, refilling is done in bulk using the same valving repeatedly.

Dispensing powder involves certain problems not generally encountered in dispensing liquid. For example, powder, depending on its composition, tends to form clumps and clog the valves. This problem is aggravated where the product is a hand cleaner and is used around water. The result is that the various valving arrangements commonly used get clogged and those are difficult to clean.

Furthermore, due to the nature of the valving and dispensing means used for powdery materials, powder refills often will not fit many of the usual liquid dispensers. Thus, either the existing dispenser must be replaced, if the user desires to switch to powder, or it must be modified.

Therefore, while all of these prior art devices are presumably adequate for the purposes for which they were designed, it is believed that it is desirable to provide a replaceable container which would make it possible to conveniently provide powdered dispensing capability to the conventional liquid dispensing apparatus commonly used and of which there are a large number already in place in the work place. In that fashion, the dispenser could be used to dispense either liquid or powder, as desired, by simply providing the appropriate refill cartridge or container. Even more importantly, it is desirable to provide a refill capability wherein the user is provided with a new valve at the time of refill and also one which will resist clogging or, if clogged, one which can be easily removed for cleaning.

SUMMARY OF THE INVENTION

It is, therefore, a principal object of this invention to provide a low-cost, efficient powder refill cartridge capable of being used in most conventional liquid dispensing apparatus and having non-clogging characteristics.

In furtherance of that object, it has been found that the typical semi-rigid plastic container used for powdery material can be employed which has a valving and dispensing assembly on the bottom which would accommodate the usual dispenser configuration.

It has been found that the flexible tube of such a valving and dispensing assembly can essentially replicate the normal flexible tube used in the liquid dispensing apparatus so far as operation is concerned and, therefore, can be configured to fit the apparatus fitments. It has also been found that such a tube can be collapsed upon actuation of the hand-engaging lever of the conventional dispenser apparatus in normal fashion so that no modification of the dispenser itself is required.

It has been found that this valving and dispensing assembly can include the flexible tube apparatus just mentioned and an assembly which will be referred to herein as a "declumper" received within the flexible tube for movement therewith and provided with a valve which is slidably received in the declumper and projects into the tube to normally close it off.

It has further been found that provision of the sliding valve will make it possible for the conventional dispenser actuating apparatus to actuate such a device to permit dispensing of the powder by actuating the operating lever or pressure bar to move the tube and declumper relatively of the valve to collapse the tube and open the valve.

Finally, it has been found, in furtherance with the above-noted principal object of the invention, that by constructing the declumper in a bifurcated manner and the valve head with a configuration such that upon actuation of the valve it contacts serrated edges or the bifurcated valve body, the problem of forming dumps in the powder can be avoided.

Accordingly, production of an improved valve and dispensing assembly of the type above described becomes the principal object of this invention, with other objects thereof becoming more apparent upon a reading of the following brief specification considered and interpreted in view of the accompanying drawings.

BRIEF DESCRIPTION OF THE PREFERRED EMBODIMENTS

Figure 1:
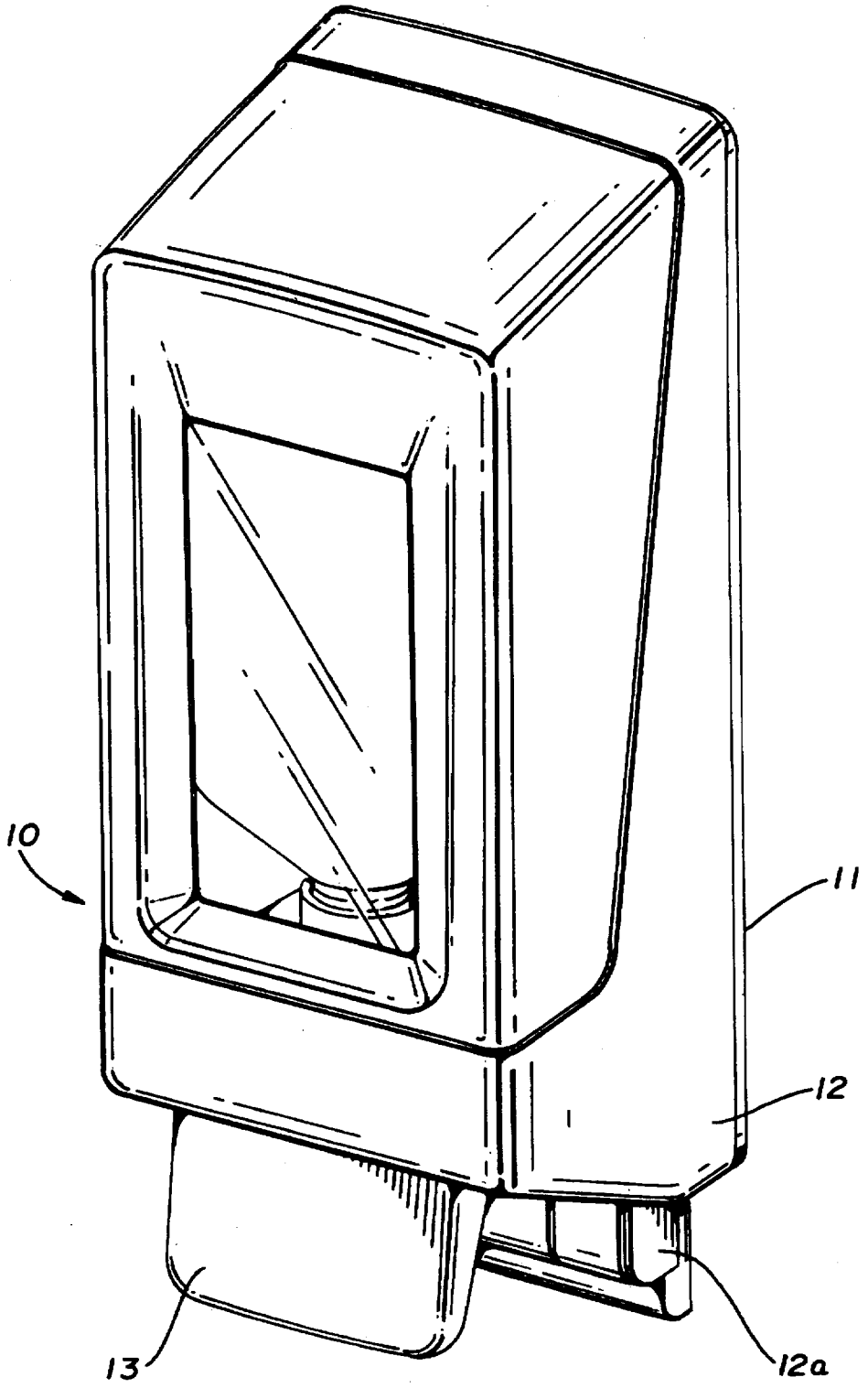
FIG. 1 is a perspective view of a conventional dispenser apparatus with a replacement container inserted therein.

Referring first to FIG. 1 of the drawings, it will be seen that the dispenser, generally indicated by the numeral 10, includes a body or back plate 11 and a cover 12 which is hinged to the back plate 11 as at 12*a* and as can be seen in some of the prior art patents referred to above. The dispenser 10 also includes a dispensing or actuating lever 13 which, in the typical dispenser 10 illustrated in FIG. 1, activates the dispenser 10 by the user engaging the dispensing lever 13 with the palm of the hand and pushing inwardly toward the back plate 11 to activate the valving means and dispense the material It may be noted here that many of the conventional dispensers have actuating levers which are pulled rather than pushed. It will also be noted that these dispensers are not always wall mounted, but may, for example, be mounted on a pedestal in the center of a wash basin. A wall-mounted dispenser is illustrated and described herein as an example only. In any event, however, the basic method of operation involves utilizing an arm, lever or bar to collapse a flexible tube to open a valve and permit the material to flow out of the dispenser.

Figure 2:
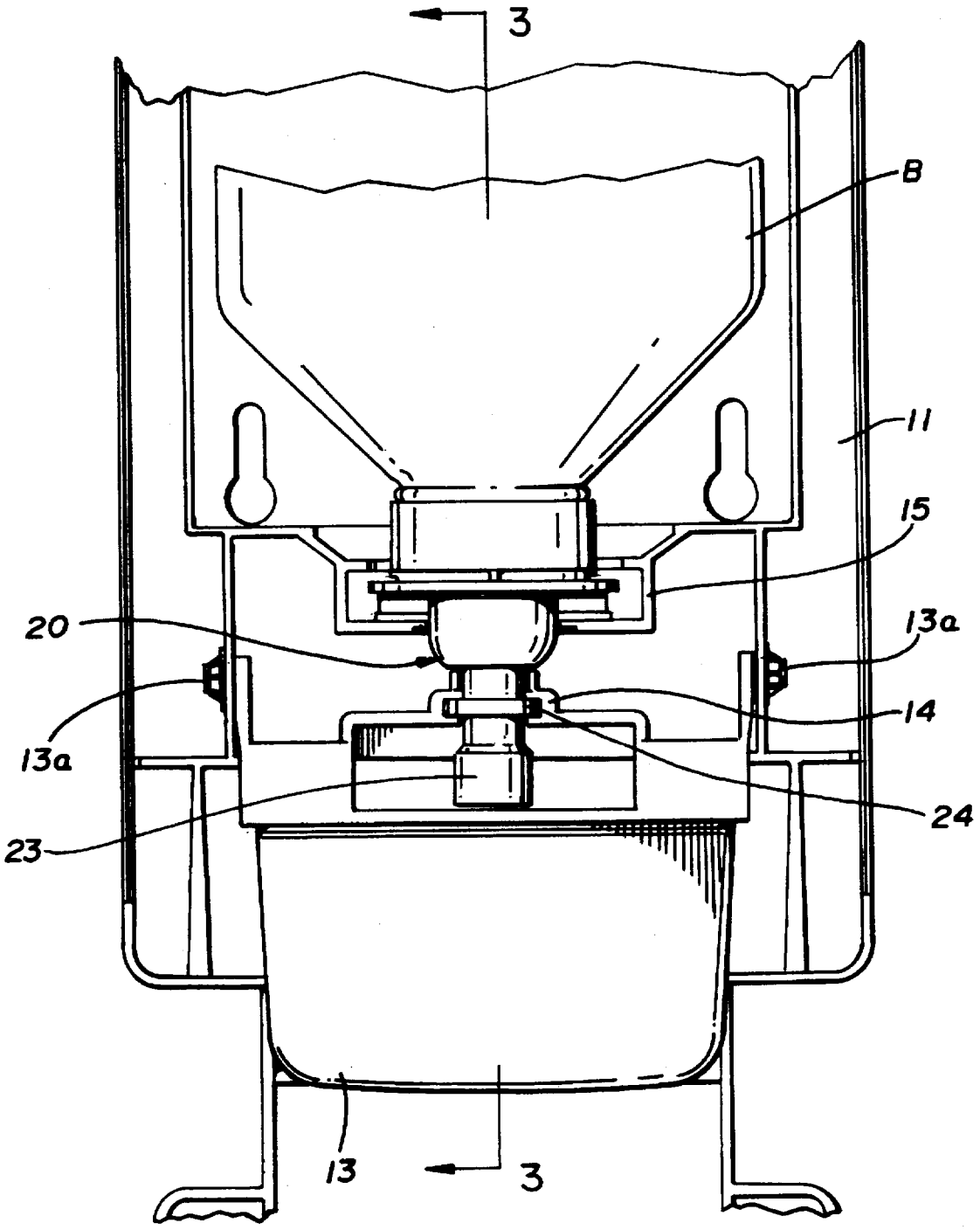
FIG. 2 is a partial front elevational view of the assembled dispenser apparatus and container with the dispenser cover in the open position for loading.

As can be seen in FIG. 2 of the drawings, the replacement container or cartridge takes the form of a semi-rigid plastic bottle in the form of the invention illustrated and is generally designated by the letter B. A fitment 14 and a fitment 15 are molded into or provided in the back plate and actuating lever of the dispenser 10 and generally are designed to receive flanges on the valve assembly which extend from the bottle B, which will be described in greater detail below. Conventional dispensing systems employ flexible tubes with radially extending ribs dimensioned and spaced so as to mate with dispenser fitments, such as 14 and 15, to securely hold and locate the tube. This arrangement is common in existing liquid dispensers. As will be seen, the present invention contemplates the use of a similar collapsible tube so that no modification of the dispenser will be required in order to dispense powder.

Figure 3:
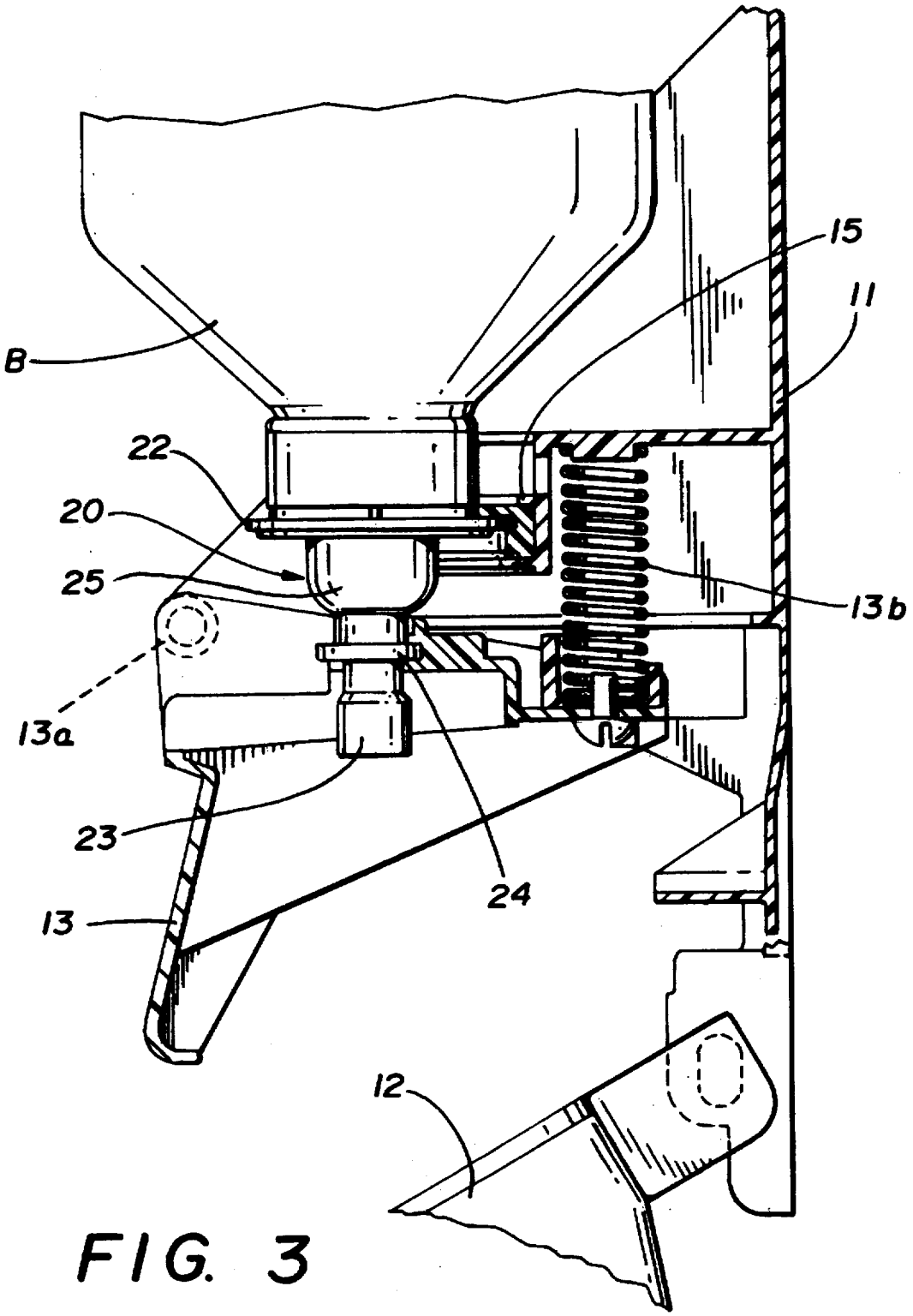
FIG. 3 is a view taken along the line 3—3 of FIG. 2, partially in section.
Figure 4:
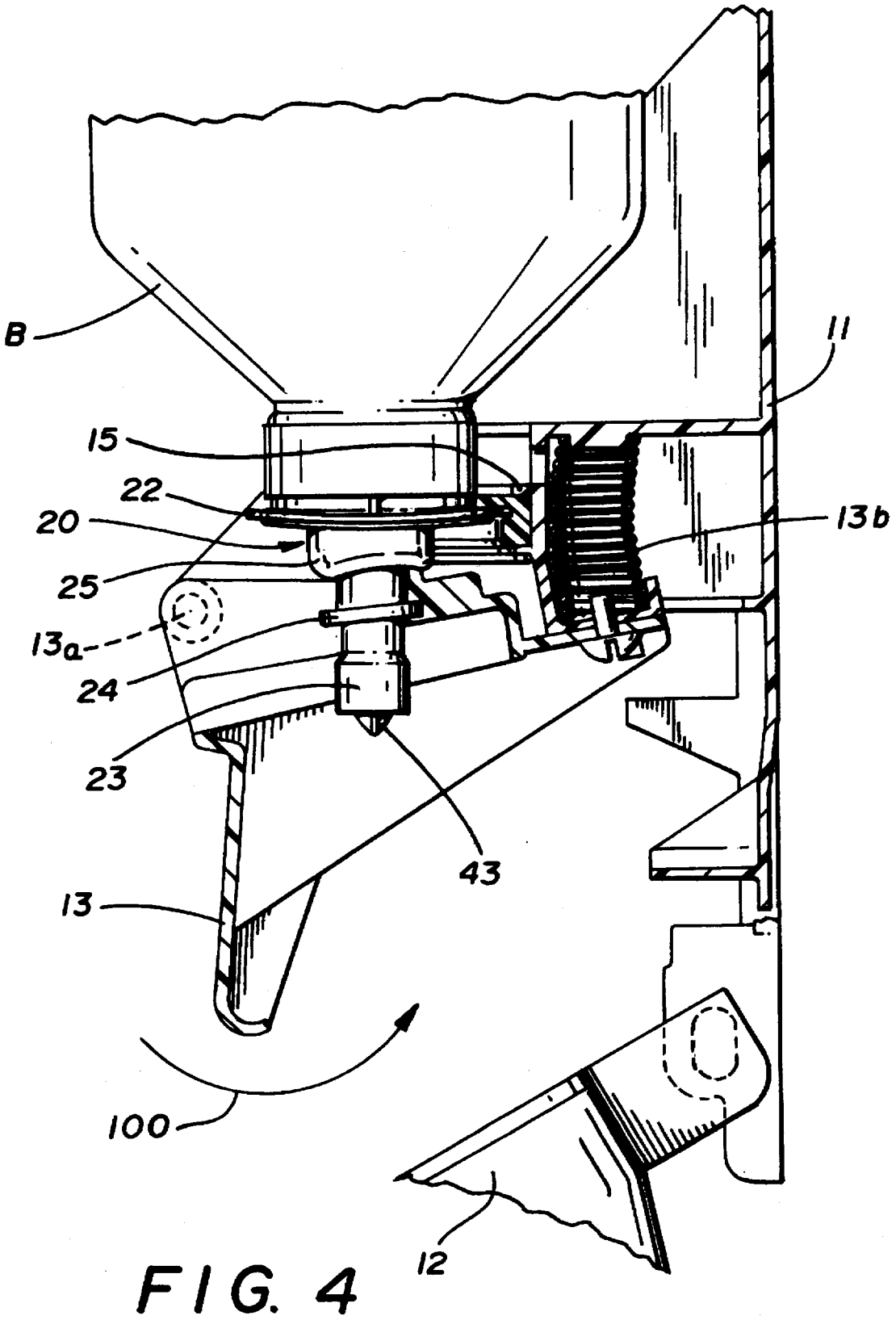
FIG. 4 is a view similar to FIG. 3 showing the actuating arm of the dispenser in the product discharge condition.

Continuing, however, with a description of the operation of the dispenser 10 per se, and referring to FIGS. 2 and 3 of the drawings, it will be seen that the actuating lever 13 is hinged, as at 13*a*, so that it can move from the position of FIG. 3 to the position of FIG. 4. In the dispenser illustrated herein, a spring 13*b* is positioned adjacent the end of lever 13 and will normally retain the lever in the inactive position of FIG. 3. However, hand pressure will rotate the lever about its mounting point in the direction of the arrow 100, thereby compressing the spring 13*b*. This movement will effectively collapse the tube of the valve assembly C as can be clearly seen by comparing the views of FIGS. 3 and 4 of the drawings.

It should be again understood that the dispenser 10 illustrated and described herein is merely an exemplar and that the valving and dispensing assembly of the present invention may be used with many other similarly functioning dispenser activating designs.

Figure 5:
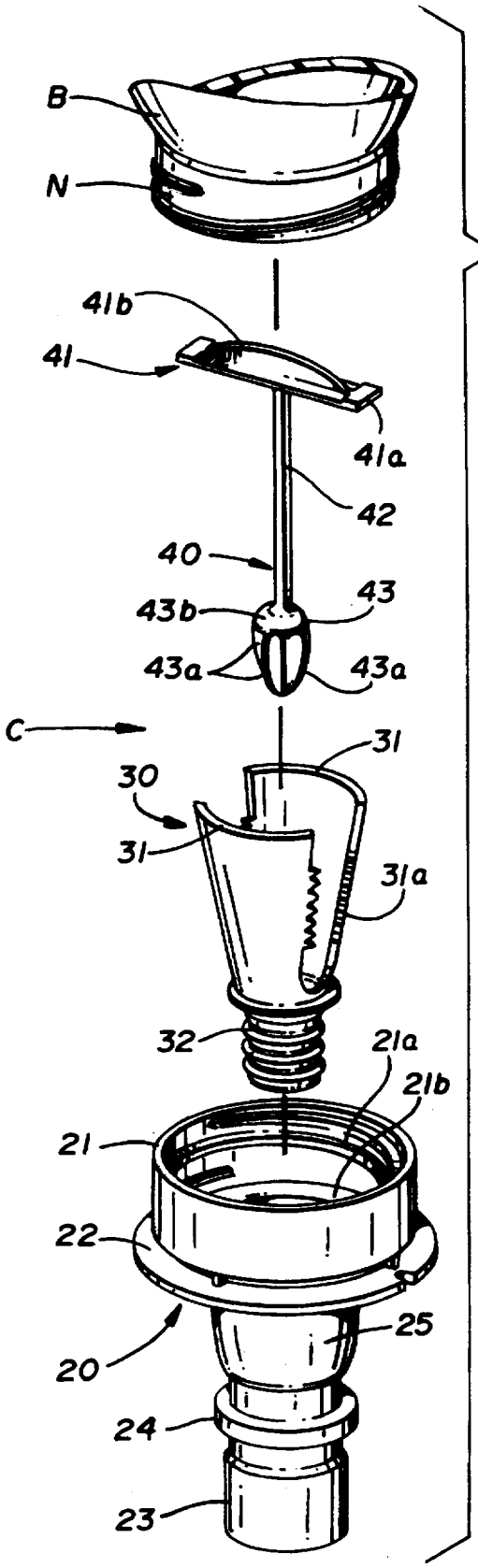
FIG. 5 is an exploded perspective view of the improved valving and dispensing assembly.
Figure 6:
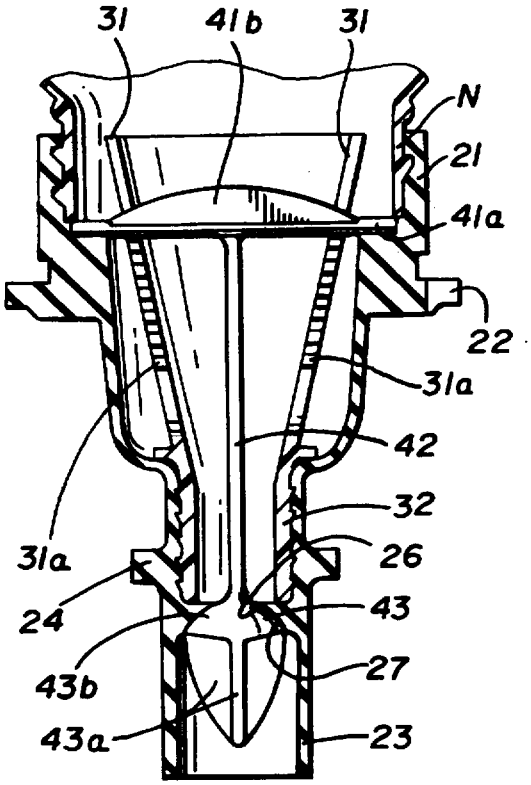
FIG. 6 is a partial sectional view of the valving and dispensing assembly in the closed position.
Figure 7:
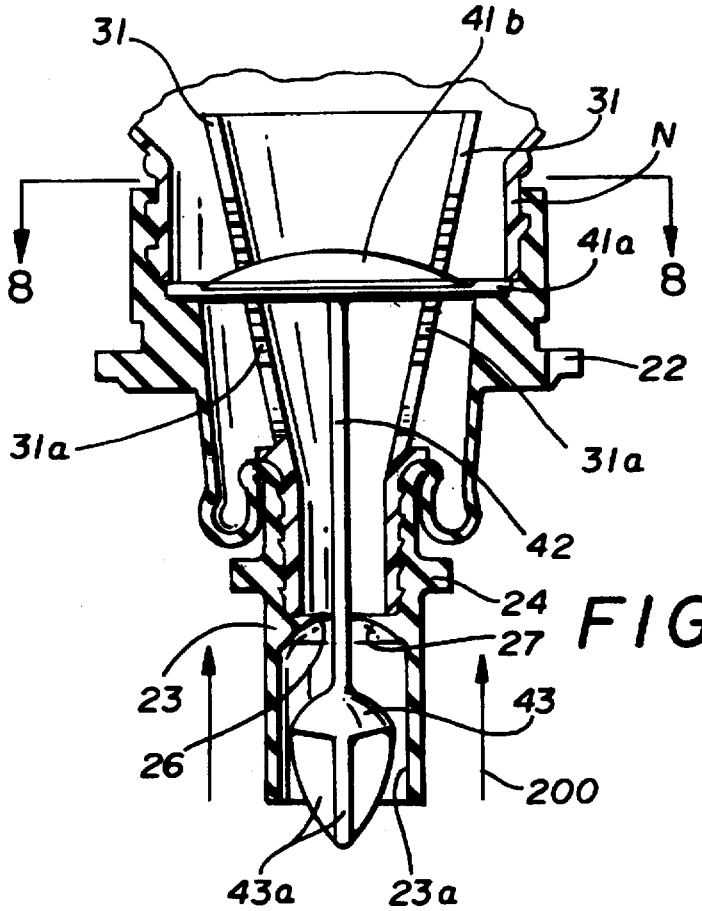
FIG. 7 is a view similar to FIG. 6 showing the valving and dispensing assembly in the product discharge position.
Figure 8:
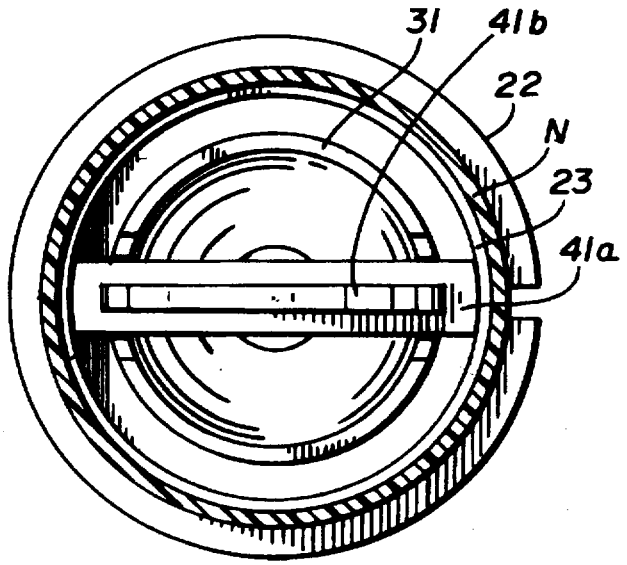
FIG. 8 is a sectional view taken along the line 8—8 of FIG. 7.

Turning next then to FIGS. 5, 6 and 7 of the drawings for a description of the valving and dispensing assembly C itself, it will be noted that the bottle B has a threaded neck N which is intended to removably receive the assembly C.

The valve and dispensing assembly C itself generally includes a flexible tube apparatus 20 which includes a radially extending circumferential flange 22 and a body 21 with the body 21 being internally threaded, as at 21*a*, so that the assembly can be threaded onto the neck N of the bottle B. However, it will be appreciated that the assembly C could be attached to container B by other suitable attachment means.

Extending downwardly from the flange 22 is the flexible tube apparatus 20 which is elongate in nature and has an enlarged collapsible section 25, a radially extending locating rib 24 and a dispensing and discharge control end 23. Locating rib 24 is receivable in fitment 14 of actuating lever 13 and flange 22 is receivable in fitment 15 of mounting plate 11 (see FIG. 2) so that when this device is placed into the typical dispenser 10, the tube will be firmly and accurately located without requiring any modification of the dispenser.

The tube portion of assembly 20 also includes a projecting neck 21, as previously described, and is, of course, hollow to accommodate material flow as will be described. A funnel-shaped product declumper 30 is received within the tube (see FIGS. 6 and 7). In that regard, it will be noted that the lower end 32 of the declumper 30 is ribbed so that it can be simply press fit into the flexible tube and retained therein during normal use and operation, as can be seen in FIG. 6 of the drawings for example. The declumper 30 is also bifurcated into two opposed segments 31, 31 and these segments have facing serrations which form comb-like projections along their opposed and facing edges, as indicated at 31*a* in FIG. 5.

The valve itself is generally indicated by the numeral 40 and includes a stop member 41 at its top end and a bottom head 43 with stop member 41 and bottom head 43 being interconnected by an elongate shank 42. The stop member 41 is generally elongate and rectangular in planer configuration, terminating in opposed ends 41*a*, and has an arcuate or semi-circular gripping member 41*b* at the top thereof. The valve is generally semi rigid, but capable of being flexed temporarily for ease of assembly as will be explained subsequently.

The bottom head 43, which fits into the flexible tube and seals it off at orifice 26, as can be seen in FIG. 6 of the drawings, has flutes 43*a* projecting therefrom. The bottom head 43 has a configuration which also facilitates assembly.

Thus, the valve 40 can be assembled from the top of FIGS. 5, 6 and 7 by inserting bottom head 4B into the top of the tube through the declumper 30 with the bottom head passing through orifice 26 which, being formed in the resilient tube, will spread a sufficient mount to permit this movement. Conversely, the stop member can be temporarily bent so as to lie alongside shank 42 and the valve 40 can be inserted from the bottom through orifice 26. In either case, it will be seen that the valve is easily removable if necessary.

In operation, the valve and dispensing assembly 20 can be assembled as shown in FIG. 6 of the drawings and, in that condition, the bottom head 43 of valve 40 closes off the dispensing orifice 26 of the tube so as to prevent any inadvertent material discharge. At that time also, the stop member 41 rests on the shoulder 21*b* of body 21 of the tube apparatus 20. Assuming at this time then that the body 21 has been attached to neck N of bottle B, the bottle has been loaded into dispenser 10 and the flange 22 has been seated in the fitment 15 of the dispenser, as shown in FIG. 2, and the locating rib 24 has been seated in the fitment 14, the device is in the condition of FIGS. 3 and 6 of the drawings and ready for operation.

Operation is simply achieved by depressing actuating lever 13 from the idle or rest position of FIG. 3 to the dispensing position of FIG. 4. This effectuates collapse of the enlarged, collapsible section 25 of the tube apparatus 20, as can be seen in FIG. 4 of the drawings, and as can also be seen in FIG. 7 of the drawings. This action collapses the tube from the position of FIG. 6 to the position of FIG. 7 generally in the direction of the arrow 200. This effectively moves the valve seat area 27 of the tube upwardly toward bottle B. The valve 40, however, remains essentially stationary and movement of the tube, as seen in FIG. 7, separates valve seat area 27 from the top surface 43*a* of bottom head 43, thereby unblocking orifice 26 so that material can flow through the dispensing end 23.

Collapse of the tube also moves the declumper 30 in the upward direction inasmuch as its projecting end 32 is fixed within the dispensing end 23 of the tube as previously described. This causes the declumper 30 to shift relatively of stop member 41 of the valve 40. The effect of this movement then is to cause the opposed ends 41*a* of the stop member 41 along the serrations 31*a* of the bifurcated portions 31,31 of the declumper 30. This sets up a vibration in the valve mechanism per se. In dispensing powdered material, it is often the case that clumps or lumps form in the material during storage and this action effectively will break up those dumps and permit a free and steady flow of the powder out through the orifice 26 in the end 23 of the tube. It will be noted that declumper 30 may only be required when certain materials, such as hydrosolic materials susceptible to dumping are being dispensed. It will be appreciated that with some material, where certain elements such as pumice, for example, have been added, clumping may be a problem and, therefore, the serrations could be eliminated.

Following the dispensing operation, release of actuating lever 13 permits the spring 13*b* to return the lever to its starting position and permits the tube and declumper to recover to their extended position of FIG. 6 at which time the bottom head 43 will reseat and close off orifice 26 and the dispenser is again ready for operation.

As can be seen then, a liquid dispenser can easily be used, or converted to use, powder without any modification whatsoever being required of the dispenser itself. As a practical matter, of course, the dispensers become more or less permanent installations in their place of use and the replacement containers, cartridges or bottles are expended from time to time. In this way the user can opt for either liquid or powder dispensing without any modification of the existing dispenser or without replacing it.

While a full and complete description of the invention has been set forth in accordance with the dictates of the patent statutes, it should be understood that modifications can be resorted to without departing from the spirit hereof or the scope of the appended claims.

Thus, while the valve and dispensing assembly of the present invention have been described in the context of dispensing soap or other cleaning material, it will be apparent that the invention need not be limited to use with such material.

What is claimed is:

1. A dispensing assembly for dispensing powdery material from a dispenser having a body for holding a container for the material and an actuating lever, comprising:

(a) a flexible tube apparatus including
  (1) a base for releasable attachment to the container and
  (2) hollow collapsible tube projecting from said base and being engagable with the actuating lever;

(b) an elongate valve receivable within said tube means and including
  (1) a stop member disposed on one end and
  (2) a closure member disposed on the opposed end and dimensioned to selectively close off the interior of said tube means;

(c) said tube being collapsible upon selective movement of the lever; and (d) said tube being movable relatively of said valve whereby said tube is moved out of closing position with respect to said closure member of said valve.

2. The dispensing assembly of claim 1 wherein said flexible tube apparatus includes a first radially outwardly projecting shoulder disposed beneath said base for releasable engagement with the dispenser body.

3. The dispensing assembly of claim 2 wherein said collapsible tube has a second radially projecting shoulder disposed adjacent its distal end for releasable engagement with the dispenser body.

4. The dispensing assembly of claim 1 wherein said flexible tube apparatus includes a body attachable to the container; an enlarged collapsible section depending from said body; and an elongate tube portion depending therefrom.

5. The dispensing assembly of claim 4 wherein said elongate tube portion has a reduced internal diameter at a point between said enlarged body portion and its distal end forming a discharge orifice; said closure member of said valve normally closing off said discharge orifice.

6. The dispensing assembly of claim 1 further characterized by the presence of a declumper releasably received within said flexible tube apparatus and having a bifurcated body extending toward said container.

7. The dispensing assembly of claim 6 wherein said declumper is elongate and has a first cylindrical portion and a second truncated conical portion extending from said first cylindrical portion.

8. The dispensing assembly of claim 7 wherein said second truncated conical portion is bifurcated to form opposed arcuate members.

9. The dispensing assembly of claim 8 wherein said opposed arcuate members have serrated longitudinal edges.

10. The dispensing assembly of claim 9 wherein said declumper is movable relatively of said valve upon collapsing engagement of the distal end of said tube by the lever; and said stop member of said valve contacts said serrated longitudinal edges of said opposed arcuate portions as said declumper is moved relatively of said valve.

11. The dispensing assembly of claim 1 wherein closure member includes at least one raised rib on its outer surface.

12. A dispensing assembly for dispensing powdery material from a dispenser having a body for holding a container for the material and an actuating lever, comprising:

(a) a flexible tube apparatus including
  (1) a base for releasable attachment to the container and
  (2) a hollow, collapsible tube projecting from said base and engagable with the actuating lever;

(b) a declumper (1) releasably received within said tube apparatus and
(2) having a bifurcated body extending from said hollow collapsible tube toward said base;

(c) a valve having
(1) a head
(2) an elongate shank projecting from said head, and
(3) said shank being slidably received in said declumper and projecting into said hollow collapsible tube with said head normally resting on said base;

(d) said head of said valve normally closing off said hollow collapsible tube; and (e) said hollow collapsible tube being movable relatively of said valve upon actuation of said actuating lever and engagement thereof with the distal end of said tube
(1) whereby said hollow collapsible tube is opened.

13. The dispensing assembly of claim 12 wherein said flexible tube apparatus includes a first radially outwardly projecting shoulder disposed beneath said base for releasable engagement with the dispenser body.

14. The dispensing assembly of claim 13 wherein said collapsible tube has a second radially projecting shoulder disposed adjacent its distal end for releasable engagement with the dispenser body.

15. The dispensing assembly of claim 13 wherein said collapsible tube has a radially inwardly directed lip disposed between the distal end thereof and said second radially outwardly projecting shoulder; and said declumper rests on said lip.

16. The dispensing assembly of claim 12 wherein said declumper is elongate and has a first cylindrical portion and a second truncated conical portion extending from said first cylindrical portion.

17. The dispensing assembly of claim 16 wherein said second truncated conical portion is bifurcated to form opposed arcuate members.

18. The dispensing assembly of claim 17 wherein said opposed arcuate members have serrated longitudinal edges.

19. The dispensing assembly of claim 16 wherein said first cylindrical portion is received within said hollow collapsible tube.

20. The dispensing assembly of claim 15 wherein said head of said valve projects beyond said lip to normally close off said hollow collapsible tube; and the distal end of said hollow collapsible tube is movable away from said head of said valve upon collapsing engagement of said tube by said actuating means.

21. The dispensing assembly of claim 18 wherein said declumper is movable relatively of said valve upon collapsing engagement of the distal end of said tube by said actuating lever; and said head of said valve contacts said serrated longitudinal edges of said opposed arcuate portions as said declumper is moved relatively of said valve.

22. The dispensing assembly of claim 12 wherein said shank of said valve terminates in an enlarged portion.

23. The dispensing assembly of claim 22 wherein at least one raised rib extends outwardly along the outer surface of said enlarged portion.

* * * * *